US005361873A

United States Patent [19]

de Jong et al.

[11] Patent Number: 5,361,873

[45] Date of Patent: Nov. 8, 1994

[54] ROPE SUSPENSION ARRANGEMENT

[75] Inventors: Johannes de Jong, Järvenpää; Pentti Alasentie, Espoo, both of Finland

[73] Assignee: Kone Elevator GmbH, Baar, Switzerland

[21] Appl. No.: 45,713

[22] Filed: Apr. 14, 1993

[30] Foreign Application Priority Data

Apr. 14, 1992 [FI] Finland ..... 921682

[51] Int. Cl.[5] ..... B66B 11/08

[52] U.S. Cl. ..... 187/264; 187/266

[58] Field of Search ..... 187/1 R, 17, 20

[56] References Cited

U.S. PATENT DOCUMENTS

| | | | |
|---|---|---|---|
| 4,030,569 | 6/1977 | Berkovitz | 187/20 |
| 4,566,562 | 1/1986 | Suzuki et al. . | |
| 4,756,388 | 7/1988 | Heikkinen | 187/20 |
| 5,010,981 | 4/1991 | Heikkinen | 187/20 |
| 5,076,398 | 12/1991 | Heikkinen . | |

FOREIGN PATENT DOCUMENTS

| | | | |
|---|---|---|---|
| 257487 | 2/1965 | Australia | 187/17 X |
| 56813 | 12/1979 | Finland . | |
| 84051 | 6/1991 | Finland . | |
| 2312449 | 5/1976 | France | 187/20 X |
| 139932 | 6/1901 | Germany | 187/20 X |
| 818250 | 7/1949 | Germany . | |
| 1104394 | 4/1961 | Germany | 187/1 R X |
| 210576 | 5/1975 | Germany . | |
| 2148229 | 5/1985 | United Kingdom . | |
| 882906 | 11/1981 | U.S.S.R. | 187/20 X |

*Primary Examiner*—Robert P. Olszewski
*Assistant Examiner*—Dean A. Reichard

[57] ABSTRACT

Traction sheave elevator has a drive machine (1) and, coupled with it, a traction sheave (3) provided with a rope groove (2), the hoisting rope (4) running over the traction sheave, an elevator car (6) and its counterweight (7) suspended on the hoisting rope and moving in an elevator shaft (6). The elevator uses at least two diverting pulleys (8,9) which causes the hoisting rope going to the traction sheave (3) and the hoisting rope coming from the traction sheave (3) to run crosswise with respect to each other. The diverting pulleys and the traction sheave are placed so that the planes of rotation of the diverting pulleys (8,9) lie on different sides of the plane of rotation of the traction sheave (3).

12 Claims, 4 Drawing Sheets

ROPE SUSPENSION ARRANGEMENT

BACKGROUND OF THE INVENTION

The present invention relates to a traction sheave elevator consisting of a drive machine and a traction sheave coupled with it, said traction sheave being provided with a rope groove, the hoisting rope running over the traction sheave, an elevator car and its counterweight, the elevator car being suspended on the hoisting rope and moving in an elevator shaft, said elevator using at least one diverting pulley so as to cause the hoisting rope going to the traction sheave and the hoisting rope coming from the traction sheave to run crossways.

DESCRIPTION OF THE PRIOR ART

A similar traction sheave elevator is previously known e.g. from German patent publication 818 250. In this known solution, the angle of contact is ¾ of the circumference of the sheave, i.e. 270°. However, this solution has several drawbacks. It is rendered practically inviable by the fact that the cross-over point of the ropes lies too close to the traction sheave. The length of free rope between the cross-over point and the point of contact with the traction sheave is only equal to the radius of the traction sheave. With traction sheaves of the size normally used, the ropes must be strongly deviated from the plane of the traction sheave to prevent attrition between them. The deviation or rope angle thus produced becomes very large. In practice, a rope angle of 3° is already large enough to cause so much wear of the traction sheave and hoisting rope that it cannot be tolerated at all in passenger elevators. To reduce the rope angle sufficiently, the diameter of the traction sheave in the German patent publication 818 250 should be twice as large as normal. This again would result in the doubling of the secondary moment constituting the load of the elevator gear. Therefore, the weight of the required traction sheave and gear would be increased, and a considerably larger drive motor would be needed. Consequently, the costs of the machinery would be almost doubled.

Previously known are also various rope suspension systems designed for geared light elevators. For example, FI patent 56813 presents a traction sheave elevator which uses a rope suspension arrangement employing at least one diverting pulley to cause the hoisting rope going to the traction sheave and the rope coming from it to run crosswise, and in which the angle of contact between the traction sheave and the hoisting rope is in the range 210°–250° so that the free length of rope from the cross-over point to the point of contact with the traction sheave is 1.9–0.7 times the diameter of the traction sheave. The traction sheave is mounted in a slightly inclined position to allow free passage of the ropes. However, a drawback is the angle between the ropes and the traction sheave, which produces a lateral pull and therefore a rapid wear of the ropes and rope grooves.

Another similar rope suspension system is presented in GB patent publication 2 148 229, which additionally uses polyurethane inserts in the rope grooves. However, this is a bad solution, because the polyurethane is very soon worn out because of the lateral pull and the heat generated.

Previously known is also FI patent 84051, in which the tilt and roll angle of the traction sheave is 1.2 degrees. The traction sheave has a number of rope grooves corresponding to the number of hoisting ropes used, and the grooves are undercut with an undercut angle of 50°–90°. The machine is mounted on a substantially horizontal bed and the attachment surface of the rear fixing parts of the motor as seen from the side of the traction sheave lies at a greater distance from the motor shaft than the attachment surface of the corresponding front fixing parts, so that when the motor is mounted on its horizontal bed, the motor shaft is inclined with respect to the horizontal plane and the traction sheave mounted on the shaft is correspondingly inclined with respect to the vertical plane. The bed and the fixing parts of the motor are so shaped that the whole machine can be rotated horizontally on its bed before being definitely fixed in place. The above-mentioned inventions have the following drawbacks:

The bed is installed in a very straight position on the floor.

Suspension of the car in constructions using one diverting pulley, in which case the ropes going downwards from the traction sheave should be installed in a perpendicular position, otherwise the angle will change as the car moves up.

If there is one diverting pulley, the running direction of the bundle of ropes going down from the traction sheave must not change. However, this does take place when the load in the car changes as the reacting forces of the rubber pads in the machine bed change. With a 1:2 roping, the ropes are usually twisted, so this rope ratio is generally not possible.

The tilt also creates the impression that the machine has been improperly installed, so less trained installers will try to correct the installation to remove the tilt, and customers also find it difficult to understand this circumstance.

SUMMARY OF THE INVENTION

The object of the present invention is to achieve an elevator rope suspension arrangement which is free of the drawbacks mentioned and in which the friction between the traction sheave and the ropes still remains the same and the ropes last longer than before. This object is accomplished by the present invention, which is characterized in that the diverting pulleys and the traction sheave are so placed that the planes of rotation of the diverting pulleys lie on different sides of the plane of rotation of the traction sheave.

A preferred embodiment of the invention is characterized in that the shafts of the diverting pulleys lie in a direction parallel to that of the shaft of the traction sheave.

Another preferred embodiment of the invention is characterized in that the distances (T,U) between the planes of rotation are such that the ropes run from the traction sheave to each diverting pulley at equal angles of departure.

Thus, yet another preferred embodiment of the invention is characterized in that the angles of departure of the ropes from the traction sheave are equal but different in direction with respect to the traction sheave grooves.

A further preferred embodiment of the invention is characterized in that the horizontal distance between the points of departure of the rope on the circumference of the traction sheave and diverting pulley is such that the hoisting rope will remain in the groove of the diverting pulley.

The invention provides several important advantages as compared with previously known techniques. For example, the fact that the radial load imposed on the traction sheave is less than half the radial load in fast elevators using double wrap suspension. The rope also undergoes fewer deflections than in double wrap suspension. Furthermore, the invention allows the use of lighter elevator cars and substantially smaller motors, reducing the energy consumption, etc. When 1:2 roping is used, larger loads are possible with the same motor size.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by referring to the attached drawings which are given by way of illustration only, and thus are not limitative of the present invention, and in which.

DESCRIPTION OF THE PREFERRED EMBODIMENT

Figure 1:
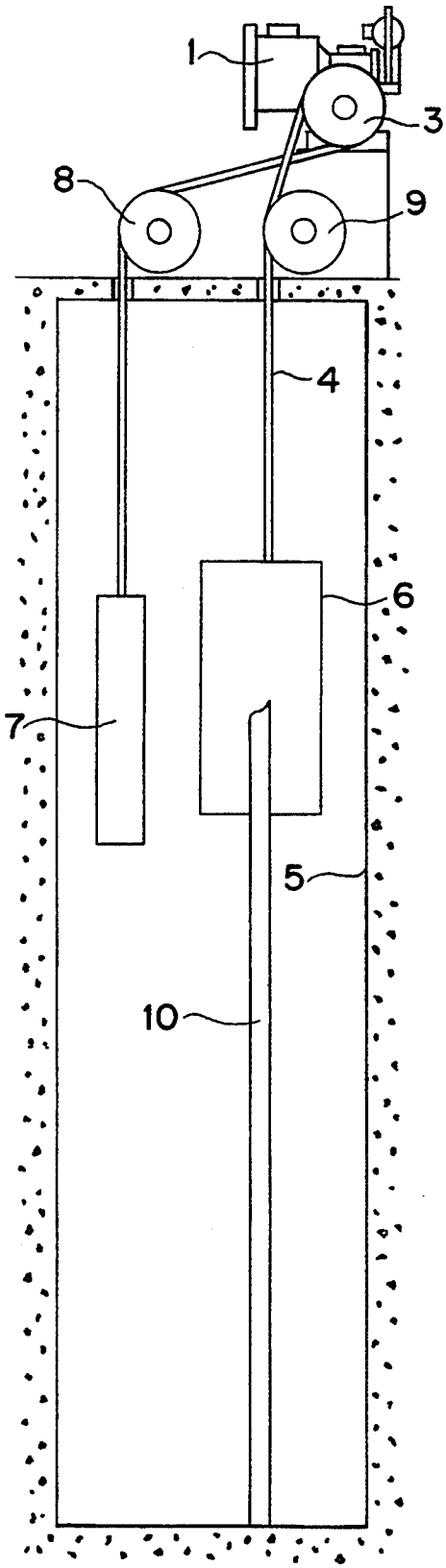
FIG. 1 presents the traction sheave elevator of the invention in side view.

FIG. 1 shows an elevator car 6 mounted on guide rails 10 in an elevator shaft 5 and moved by means of a hoisting rope 4. The drive machine 1 of the elevator is placed on top of the elevator shaft. Coupled with the drive machine 1 is a traction sheave 3 provided with a rope groove 2. The hoisting rope 4 coming from the elevator car 6 runs via point b on the left-hand side of diverting pulley 9 as seen from the front, to the traction sheave 3 and via point d on the right-hand side of the traction sheave 3 back down and crossways, further via point a on the left-hand side of diverting pulley 8 to the counterweight 7, so that the two portions of the rope 4 form a cross-over without touching each other. In this crosswise arrangement of the hoisting rope 4, the hoisting rope 4 going to the traction sheave 3 and the hoisting rope 4 coming from the traction sheave 3 are at an equal angle $\alpha$. The diverting pulleys 8 and 9 are located in the machine room 11 above the elevator shaft 5. If necessary, they can also be placed in the shaft.

Figure 2:
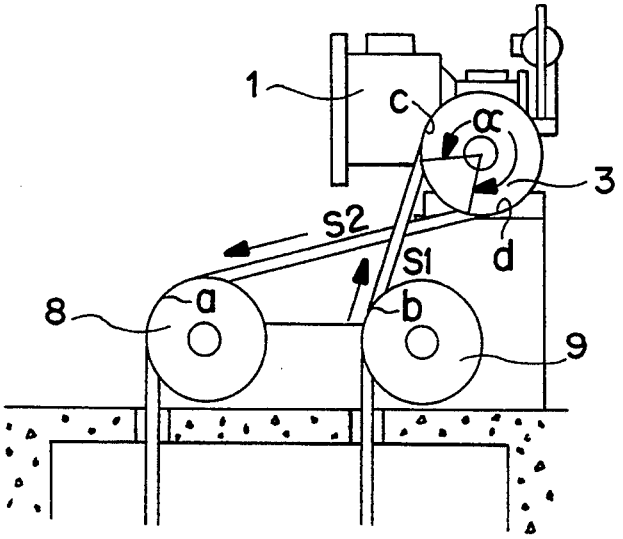
FIG. 2 is a diagram of the hoisting rope arrangement of the traction sheave elevator of FIG. 1.

FIG. 2 shows the rope arrangement of the elevator. Here, rope S1 runs via point b on the circumference of diverting pulley 9 to the traction sheave 3 via point c and further via point d crosswise to diverting pulley 8 via point a. The ropes coming from the traction sheave 3 form an angle of size $\alpha$.

Figure 3:
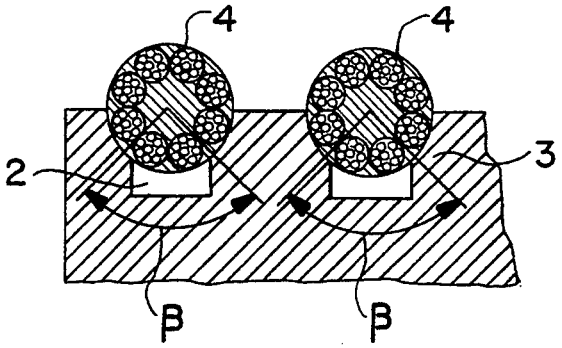
FIG. 3 presents a cross-section of the rope groove of the elevator of the invention.

FIG. 3 presents a cross-section of the traction sheave 3 of the elevator of the invention, showing the undercut of the rope groove 2. The sheave may have several rope grooves 2, depending on the number of ropes. FIG. 3 shows two rope grooves 2.

Figure 4:
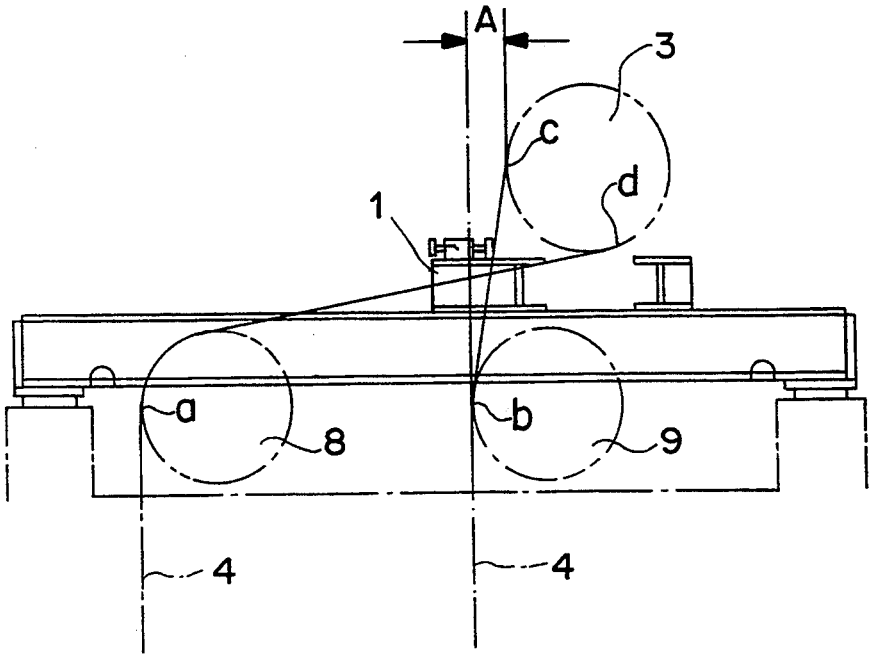
FIG. 4 presents the hoisting rope arrangement, in which the distance A is visible.

FIG. 4 is a lateral view of the drive machine 1 and the traction sheave 3 and diverting pulleys 8 and 9, showing how they are placed in the machine room 11. The figure also shows the measure A, which is determined by the points c and b on the left-hand edge of the circumference of the traction sheave 3 and diverting pulley 9. These are the points at which the rope departs from the sheave. Measure A is the horizontal distance between these points, and it must be such that the rope will remain in tile groove 2. As seen from the side, the diverting pulleys 8 and 9 are at the same height.

Figure 5:
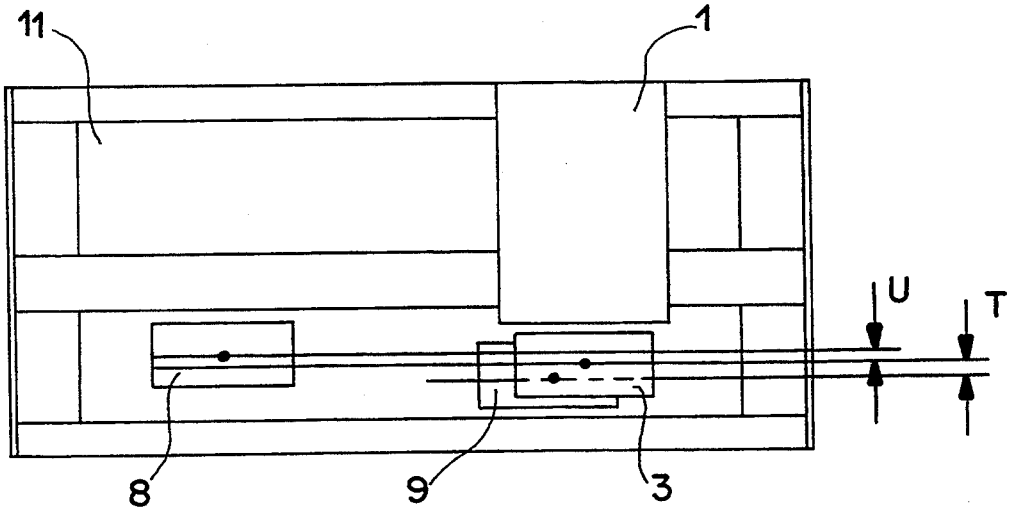
FIG. 5 presents a top view of the machine room equipment.

FIG. 5 presents a top view of the machine room equipment. The figure shows how the diverting pulleys 8 and 9 and the traction sheave 3 are located with respect to each other, The drive machine 1 lies next to the traction sheave 3. Diverting pulley 8 is removed by distance U from the assumed middle line of the plane of rotation of the traction sheave 3 towards the machine, while diverting pulley 9 is removed by distance T away from the machine. The shafts of the diverting pulleys 8 and 9 lie parallel to each other. In the machine room 11, the drive machine 1 may be placed on the left or on the right, depending e.g. on where the elevator shaft is located in the building.

Figure 6:
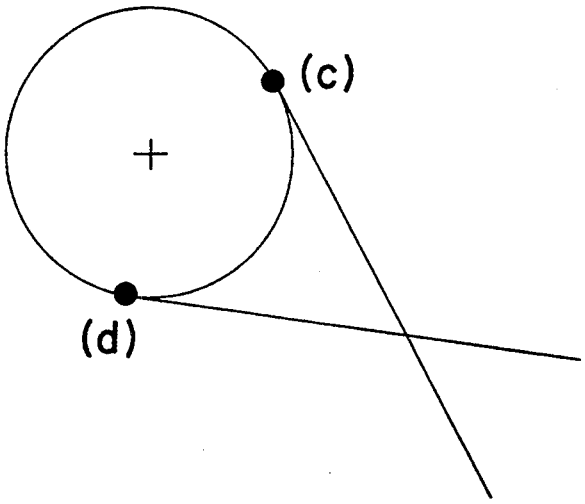
FIGS. 6*a* and 6*b* present the angles of the ropes departing from the traction sheave in a side and top view, respectively.
Figure 6:
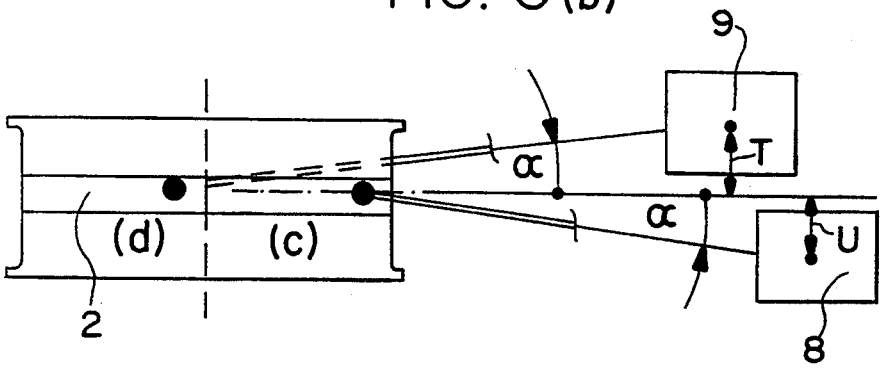

FIGS. 6*a* and 6*b* show the traction sheave 3 and the diverting pulleys 8 and 9, the angles $\alpha$ formed by the diverting pulleys in relation to the traction sheave 3, as well as the distances T and U from the assumed middle line. Points c and d are the points on the circumference of the traction sheave 3 where the ropes are separated from the traction sheave 3, and the hoisting ropes 4 run further across each other, without touching each other, over the diverting pulleys 8 and 9. The rope coming from diverting pulley 9 meets the traction sheave 3 at point c and leaves it at point d and runs further to diverting pulley 8. The diverting pulleys 8 and 9 form equal angles $\alpha$ with respect to the traction sheave 3. The angles $\alpha$ are equal in magnitude but different in direction.

It is obvious to a person skilled in the art that different embodiments of the invention are not restricted to the examples described above, but that they may instead be varied within the scope of the following claims. For example, the placement of the drive machine 1 in the machine room is not important, because the hoisting rope can be guided in any way by means of the diverting pulleys. Therefore, the drive machine may also be placed at the lower part of the elevator shaft or at the side of the shaft on any floor. The essential feature is the fact that the arrangement of the invention produces a large friction between the traction sheave and the hoisting rope of a traction sheave elevator. As a result, the weight of the whole elevator equipment can be reduced. Naturally, it is still possible to use several hoisting ropes and rope grooves.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Traction sheave elevator comprising a drive machine and a traction sheave, the traction sheave being coupled to the drive machine and being provided with a rope groove, a hoisting rope running over the traction sheave, an elevator car and a counterweight, the counterweight being suspended on the hoisting rope and the elevator and counterweight being movable in an elevator shaft, said elevator using at least two diverting pulleys causing the hoisting rope going to the traction sheave and the hoisting rope coming from the traction sheave to run crosswise with respect to each other, the hoisting rope extending between the at least two diverting pulleys, the at least two diverting pulleys and the traction sheave being rotatable and being placed so that planes of rotation of the diverting pulleys lie on different sides of a plane of rotation of the traction sheave, distances between the planes of rotation of the at least two diverting pulleys to the plane of rotation of the traction sheave being equal such that angles of departure ($\alpha$) of the hoisting rope from the traction sheave to each diverting pulley are equal.

2. Traction sheave elevator according to claim 1, wherein shafts of the diverting pulleys lie in a direction parallel to that of a shaft of the traction sheave.

3. Traction sheave elevator according to claim 1, wherein angles of departure of the ropes from the traction sheave are equal in magnitude but different in direction with respect to the groove of the traction sheave.

4. Traction sheave elevator according to claim 1, wherein the diverting pulleys are placed relative to the traction sheave so that a horizontal distance between points of departure of the rope on the circumference of the traction sheave and at least one diverting pulley is such that the hoisting rope will remain in a groove of the at least one pulley.

5. Traction sheave elevator according to claim 2, wherein the diverting pulleys are placed relative to the traction sheave so that a horizontal distance between points of departure of the rope on the circumference of the traction sheave and at least one diverting pulley is such that the hoisting rope will remain in a groove of the at least one diverting pulley.

6. Traction sheave elevator according to claim 3, wherein the diverting pulleys are placed relative to the traction sheave so that a horizontal distance between points of departure of the rope on the circumference of the traction sheave and at least one diverting pulley is such that the hoisting rope will remain in a groove of the at least one diverting pulley.

7. Traction sheave elevator according to claim 1, wherein the at least two diverting pulleys includes a pair of diverting pulleys, the hoisting rope extending from a first pulley of the diverting pulleys of the pair to the traction sheave and then returning to engage a second pulley of the diverting pulleys of the pair, the hoisting rope extending from the first pulley being positioned in an area between the first and second pulleys and the hoisting rope engaging the second pulley being positioned outside of the area between the first and second pulleys such that the hoisting rope passes between the first and second pulleys only once.

8. Traction sheave elevator according to claim 7, wherein the hoisting rope encircles the traction sheave at least once and wherein distances between planes of rotation for the first and second pulleys and the traction sheave are noncoincident and are generally parallel.

9. Traction sheave elevator according to claim 7, wherein the first pulley, second pulley and traction sheave each have an axis of rotation and wherein generally vertical planes passing through the axes of rotation are noncoincident.

10. Traction sheave elevator according to claim 9, wherein the generally vertical plane passing through the axis of rotation of the first pulley is between the generally vertical planes passing through the axes of rotation of the second pulley and the traction sheave.

11. Traction sheave elevator according to claim 1, wherein the traction sheave has an axis of rotation, a generally vertical plane passing through the axis of rotation of the traction sheave being outside an area between the at least two diverting pulleys.

12. Traction sheave elevator according to claim 1, wherein the plane of rotation of the traction sheave lies midway between the planes of rotation of the diverting pulleys.

* * * * *